US008245653B2

(12) United States Patent
McCaffrey et al.

(10) Patent No.: US 8,245,653 B2
(45) Date of Patent: Aug. 21, 2012

(54) SPLIT SHELL CIRCULAR FURNACE AND BINDING SYSTEMS FOR CIRCULAR FURNACES

(75) Inventors: Felim P. McCaffrey, Toronto (CA); Nils W. Voermann, Toronto (CA); Clarence A. Nichols, Mississauga (CA); Robert J. Veenstra, Thamesford (CA); Jimmy Sarvinis, Jr., Oakville (CA); Keith E. Joiner, Burlington (CA); Brett T. Emery, Burlington (CA)

(73) Assignee: Hatch Ltd., Mississauga (CA)

( * ) Notice: Subject to any disclaimer, the term of this patent is extended or adjusted under 35 U.S.C. 154(b) by 1016 days.

(21) Appl. No.: 11/070,035

(22) Filed: Mar. 2, 2005

(65) Prior Publication Data

US 2006/0196399 A1 Sep. 7, 2006

(51) Int. Cl.
*F23M 5/00* (2006.01)

(52) U.S. Cl. ..... 110/336

(58) Field of Classification Search ..... 110/336, 110/337; 266/198, 280; 217/95; 52/162; 373/71, 72, 76; 264/30
See application file for complete search history.

(56) References Cited

U.S. PATENT DOCUMENTS

| | | | | |
|---|---|---|---|---|
| 273,742 | A | | 3/1883 | Kent |
| 1,217,185 | A | | 2/1917 | Johnson, Jr. |
| 1,440,753 | A | | 1/1923 | Wager |
| 1,448,060 | A | | 3/1923 | Graham |
| 1,773,339 | A | | 8/1930 | Beall |
| 2,068,863 | A | | 1/1937 | Mannshardt |
| 2,127,842 | A | | 8/1938 | Hosbein |
| 2,840,364 | A | | 6/1958 | Abbott et al. |
| 3,618,818 | A | | 11/1971 | Puyo et al. |
| 3,682,457 | A | | 8/1972 | Hollingsworth |
| 4,308,967 | A | | 1/1982 | Vater et al. |
| 4,505,210 | A | * | 3/1985 | Schuck et al. ..... 110/336 |
| 4,813,654 | A | * | 3/1989 | Singler ..... 266/262 |
| 5,289,942 | A | * | 3/1994 | Fawley ..... 220/565 |
| 5,867,523 | A | | 2/1999 | Wasmund et al. |

FOREIGN PATENT DOCUMENTS

| | | | |
|---|---|---|---|
| CA | 2454720 | A1 | 2/2003 |
| CA | 2501944 | A1 | 4/2004 |

OTHER PUBLICATIONS

PCT International Search Report, Issued Jun. 13, 2006, in corresponding International Application No. PCT/CA2006/000305.

* cited by examiner

*Primary Examiner* — Kenneth Rinehart
(74) *Attorney, Agent, or Firm* — K&L Gates LLP

(57) ABSTRACT

Binding systems are described for applying compressive forces on the refractory hearth and/or refractory sidewall of a circular furnace having an outer metal shell which may be segmented. One preferred binding system comprises a tensioning band having one or more segments which extends around the furnace hearth and/or sidewall, with a resilient connection being provided between the opposite ends of the band and, where the band is segmented, resilient connections are also provided between the ends of adjacent segments. Another preferred binding system comprises a plurality of pivoting members provided around the circumference of the furnace. Each pivoting member is acted upon by a force-generating member which applies a controlled amount of force to the pivoting member and causes it to apply a compressive force to the hearth.

1 Claim, 6 Drawing Sheets

SPLIT SHELL CIRCULAR FURNACE AND BINDING SYSTEMS FOR CIRCULAR FURNACES

FIELD OF THE INVENTION

The present invention relates to improvements in circular furnaces having walls comprised of refractory materials. More particularly, the invention relates to binding systems for applying compressive forces on the refractory hearth and/or refractory side wall of a circular furnace, and to circular furnaces incorporating such binding systems.

BACKGROUND OF THE INVENTION

Furnaces used in the smelting and converting of ferrous and non-ferrous ores and concentrates generally have a bottom wall (hearth) and vertical walls (sidewalls) comprised of refractory bricks, a structural metal shell surrounding the refractory hearth and sidewalls, and a roof or off-gas hood. Adequate compression of the furnace walls, and particularly the hearth, is critical to maximize furnace campaign life and to prevent costly and potentially catastrophic furnace failure.

During heating of the furnace to operating temperature, the individual bricks comprising the hearth and the wall refractories expand, resulting in outward expansion of the furnace. Conversely, cooling of the furnace results in contraction of the individual bricks and overall shrinking of the furnace. If the compressive forces on the hearth or the walls are insufficient, gaps may be formed between the bricks during cooling phases of the furnace operation. These gaps can be infiltrated with molten metal or other material, resulting in permanent, incremental growth of the furnace as it is repeatedly heated and cooled. This incremental expansion of the furnace, known as ratcheting, can reduce the furnace campaign life by yielding the steel shell to the point that it eventually ruptures, and/or by allowing the molten furnace contents to escape through the expanded and infiltrated joints between bricks.

Binding systems for rectangular furnaces are well known, and generally comprise regularly spaced vertical beams known as buckstays, which are held together at the top and bottom by resilient horizontal tie members extending across the furnace side walls. This binding arrangement can provide a substantially constant load on the furnace wall and hearth refractories, independent of furnace thermal expansion or contraction, thus preventing thermal ratcheting and infiltration of brick joints. However, such binding systems are not directly adaptable to use in circular furnaces.

The need for adequate compression is particularly important in circular furnaces, where the structural metal shell is subjected to large amounts of tension as the furnace hearth and wall refractories expand radially to a greater extent with each thermal cycle or ratchet. This problem can result in reduced furnace life or furnace failure by escape of molten furnace contents through infiltrated brick joints or by stretching of the furnace shell to the point of rupture, and has not yet been addressed in a satisfactory manner. One type of binding system for a circular furnace is described in U.S. Pat. No. 5,867,523 (Wasmund et al.), issued on Feb. 2, 1999. The system described by Wasmund et al. comprises a plurality of tensioning bindings resiliently connecting the segments of a structural metal shell of a circular furnace. These bindings apply a compressive force on the side walls of the furnace. The Wasmund patent is incorporated herein by reference in its entirety.

There remains a need for improved furnace binding systems for circular furnaces, and for circular furnaces in which tension in the outer metal shell can be maintained within acceptable limits while providing adequate compression of the brickwork to prevent thermal ratcheting and infiltration of the brick joints, particularly in the area of the hearth.

SUMMARY OF THE INVENTION

The present invention overcomes the above-described problems of the prior art by providing binding systems for applying compressive forces on the refractory hearth and/or refractory side wall of a circular furnace, and by providing circular furnaces incorporating such binding systems. Preferably, the binding systems of the invention apply compressive forces in the area of the hearth.

One binding system according to the invention applies radial compression on the furnace through a plurality of pivoting members spaced around the outside of the furnace, each pivoting member applying an inwardly directed compressive force on the hearth.

Another radial binding system according to the invention comprises one or more bands encircling the furnace shell and maintaining a radial compressive force on the hearth, each of the bands comprising one or more segments, with resilient connections being provided between the ends of the segment (s).

In one aspect, the present invention provides a circular furnace having a lower end and an upper end. The furnace comprises (a) a hearth comprised of a refractory material and located at the lower end of the furnace; (b) a generally cylindrical sidewall extending from the hearth to the upper end of the furnace, the sidewall being comprised of a refractory material; (c) a generally cylindrical metal shell surrounding the hearth and the sidewall, the shell being under tension to apply a radially inwardly directed compressive force on the furnace; and (d) one or more tensioning members associated with the shell for maintaining tension in the shell and applying a radial compressive force to the furnace; wherein each of the tensioning members comprises an elongate band having first and second ends, and having sufficient length to extend around the sidewall, with a resilient connection being provided between opposite ends of the band.

In another aspect, the present invention provides a binding system for maintaining radial compression on a refractory hearth of a circular furnace. The system comprises a plurality of radial binding elements spaced from one another about the hearth. Each of the radial binding elements comprises (a) a pivoting member having a first end, a second end and a pivot point, the first end of the pivoting member applying a radially inwardly directed compressive force on the hearth, wherein pivoting of the pivoting member about the pivot point results in a change in the compressive force applied to the hearth by the pivoting member; (b) a force generating member for applying a force to said pivoting member, the force applied to the pivoting member being directed so as to cause the pivoting member to pivot about the pivot point and to cause the first end of the pivoting member to be radially inwardly biased into compressive contact with the hearth.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
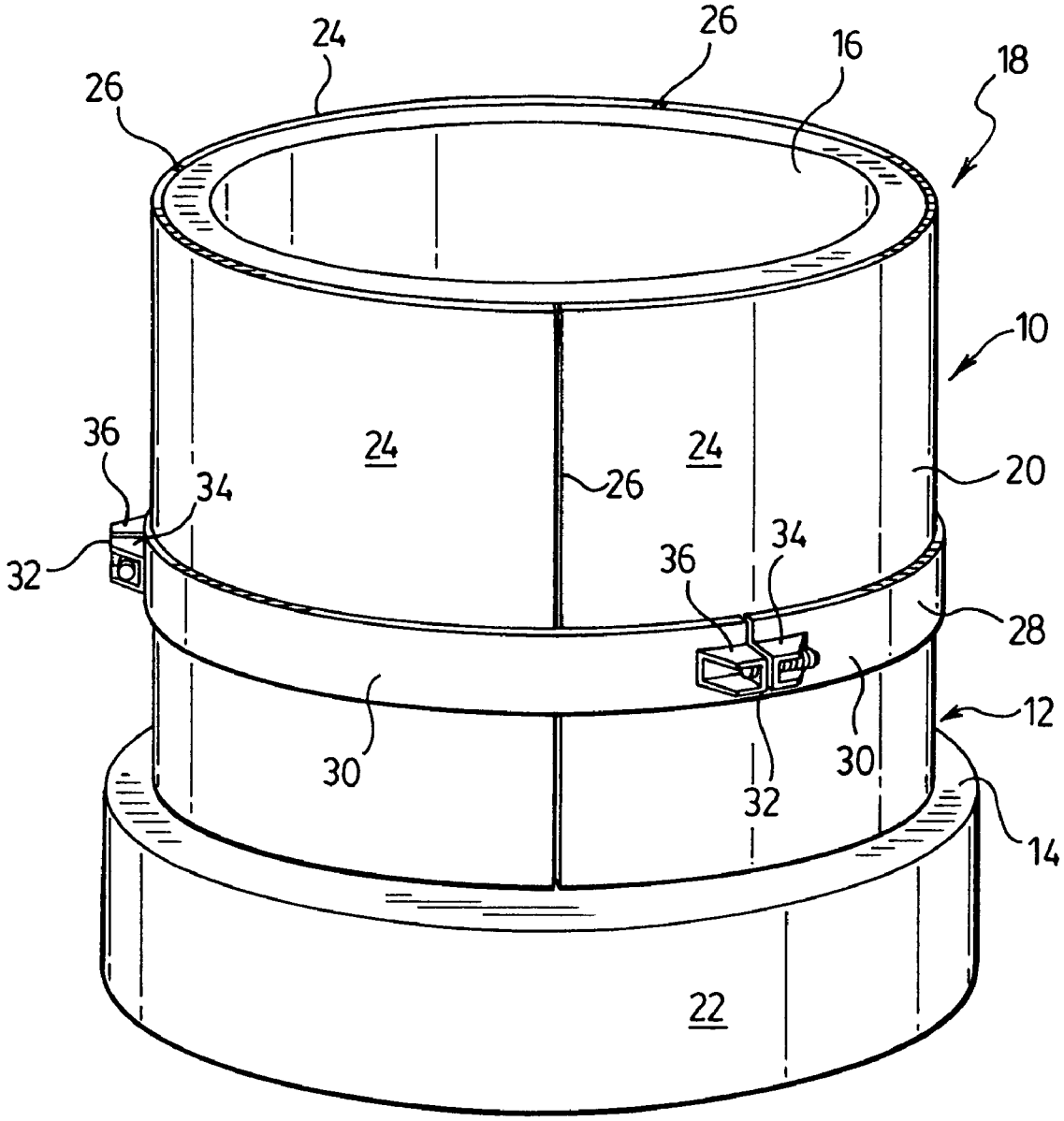
FIG. 1 is a perspective view showing a preferred circular furnace according to the invention, including a first preferred radial binding system.
Figure 2:
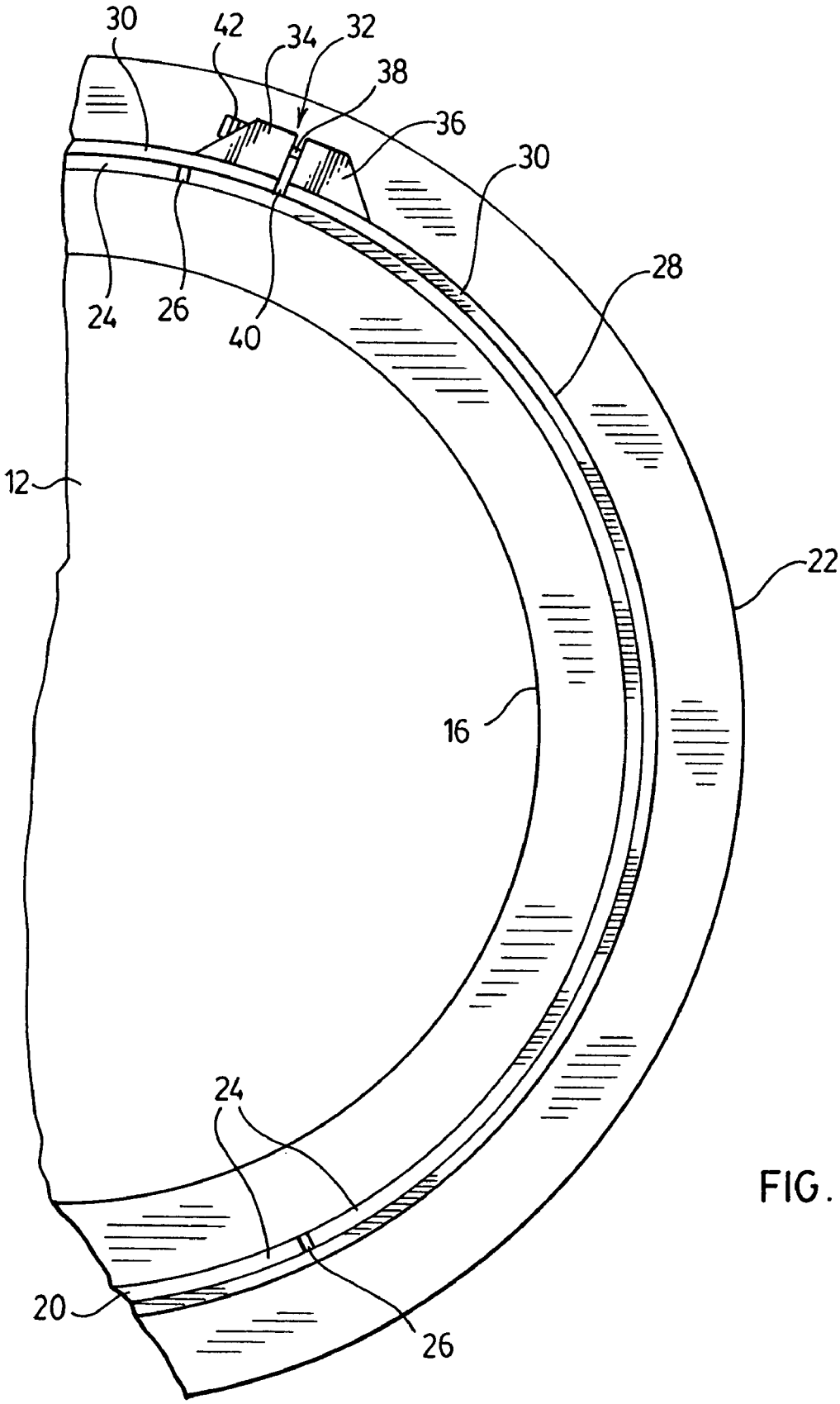
FIG. 2 is a partial plan view of the furnace of FIG. 1.

FIG. 1 illustrates a preferred circular furnace 10 according to the present invention. It will be appreciated that the drawings have been simplified to eliminate details of furnace 10 which are unnecessary for an understanding of the present invention.

Furnace 10 has a hearth 12 at its lower end 14 and a generally cylindrical side wall 16 extending from the hearth 12 to the upper end 18 of the furnace 10. Both the hearth 12 and the side wall 16 are comprised of a refractory material such as refractory bricks or a castable refractory material in a conventional manner. The hearth 12 and side wall 16 are sometimes referred to herein as the "furnace refractories". The side wall 16 may be of a composite structure of water-cooled elements and refractory material, as in the above-mentioned patent to Wasmund et al. Structural details of the furnace refractories are omitted from the drawings.

The furnace 10 is preferably also provided with a generally cylindrical, structural metal shell 20 surrounding the side wall 16, the shell 20 extending between the lower end 14 and upper end 18 of furnace 10. The shell 20 may preferably be provided with apertures to receive cooling equipment, and may also be provided with tap holes through which material can be removed from the furnace. These features are not shown in the drawings.

As shown in the drawings, the furnace 10 may preferably be supported on a base 22 of reinforced concrete or other suitable material. However, it will be appreciated that the furnace 10 could instead be mounted for tilting.

The furnace 10 shown in the drawings is a "split-shell" circular furnace, meaning that the cylindrical metal shell 20 of furnace 10 is made up of two or more arcuate shell plates 24. In the preferred embodiment shown in the drawings, the shell 20 is comprised of three shell plates 24. However, it will be appreciated that the number of shell plates is not critical to the present invention and may be either more or less than the number of shell plates 24 shown in the drawings. For example, the furnace 10 may have a one-piece shell. Furthermore, the lower portion of the furnace 10, in the vicinity of hearth 12, may be provided with a greater number of shell plates than the upper portion of the furnace 10.

As will be appreciated, a number of circumferentially spaced joints 26 are formed in the outer metal shell 20 between shell plates 24. There are small gaps at the joints 26 which may preferably be sealed by sliding cover plates (not shown). In the illustrated embodiment, the joints 26 between the shell plates 24 are left uncovered.

The outer metal shell 20 is maintained under tension to apply a radially inwardly directed compressive force on the furnace refractories 12, 16. In split-shell furnace 10, adjacent shell plates 24 may preferably be connected by resilient tensioning members such as those described in the above-mentioned Wasmund et al. patent (not shown). These tensioning members apply a radial compressive force to the furnace side wall 16.

In a first preferred embodiment of the invention, furnace 10 is provided with a tensioning band 28 which extends around the shell 20 proximate the lower end 14 of furnace 10. The tensioning band 28 provides sufficient compressive forces at the lower end 14 of furnace 10 to resist radial expansion of the hearth 12.

The tensioning band 28 may comprise a single, continuous metal band, the ends of which are resiliently connected to one another. Alternatively, as shown in the drawings, the tensioning band 28 may comprise two or more segments 30, with the ends of adjacent segments 30 being resiliently connected to one another. Although only one tensioning band 28 is shown in the drawings, it will also be appreciated that furnace 10 may be provided with two or more tensioning bands 28.

The resilient connections in the tensioning band 28 are provided by resilient tensioning members 32. The tensioning members 32 are positioned at the ends of the segments 30 of the tensioning band 28, and comprise a first bracket 34 attached to an end of one segment 30 and a second bracket 36 attached to an end of an adjacent segment 30. At least one binding member 38 extends across a gap 40 between the adjacent segments 30. Preferably, each binding member 38 comprises an elongate, threaded rod.

Figure 3:
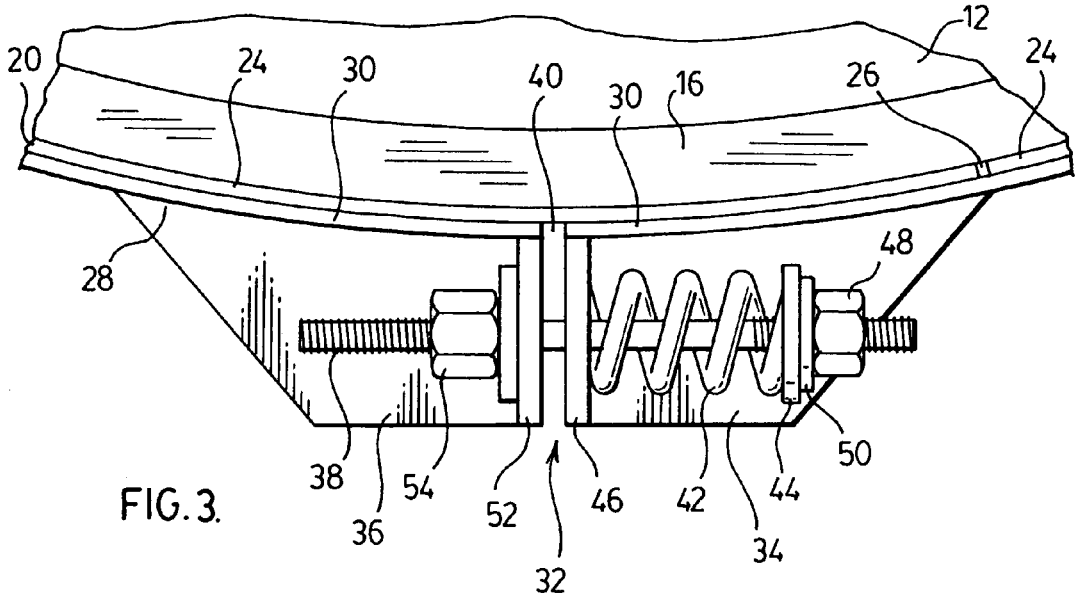
FIG. 3 is a close-up of one of the radial bindings shown in FIGS. 1 and 2.

Each binding member 38 is resiliently connected to at least one of the brackets 34, 36 so as to permit expansion and contraction of outer shell 20 in response to furnace expansion and contraction. As shown in FIG. 3 one end of each binding member 38 extends through a spring 42 which resiliently connects the binding member 38 to bracket 34. The spring 42 is maintained under compression between a pair of retainer plates 44, 46. A first retainer plate 44 is attached to the end of the binding member 38 by a nut 48 and washer 50 assembly. A second retainer plate 46 is formed as part of bracket 34 and is located at the end of a segment 30 along the gap 40. The retainer plates 44, 46 are apertured to receive the binding member 38.

The opposite end of binding member 38 extends through retainer plate 52 of bracket 36 and is retained in position by a nut 54 threaded onto binding member 38 on retainer plate 52.

Figure 4:
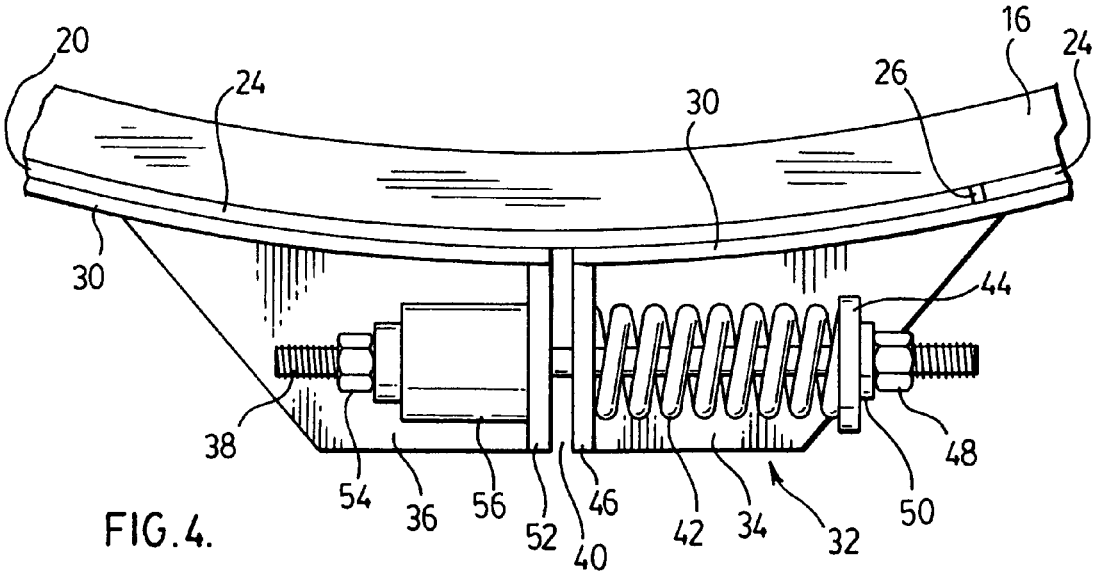
FIG. 4 is a close-up of an alternate preferred form of radial binding according to the first preferred embodiment of the invention.

The tension of spring 42 is adjusted by varying its length. As will be appreciated, reducing the spring length increases the tension of spring 42, thereby increasing tension of the segments 30 and thus the shell 20, and increasing compression of the furnace refractories 12, 16. Conversely, increasing the spring length decreases the tension of spring 42, thereby reducing the tension of shell 20 and decreasing compression of the furnace refractories 12, 16. Adjustment of the spring length may preferably be accomplished by manually turning nut 54. Alternatively, in the preferred tensioning member 32' shown in FIG. 4, a hollow hydraulic cylinder 56 may be provided between the nut 54 and retainer plate 52 for adjusting the spring tension.

Figure 5:
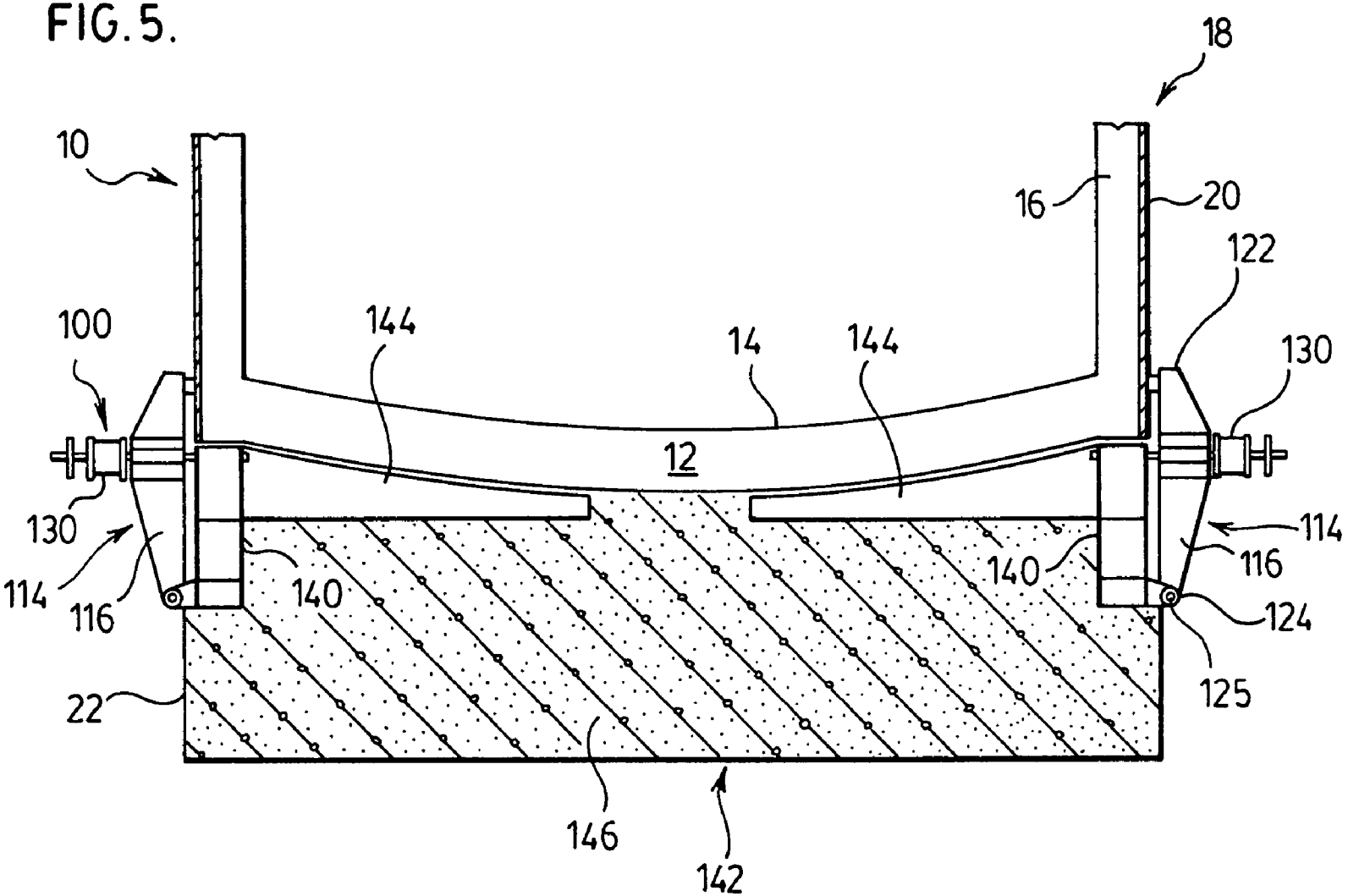
FIG. 5 is a cross-sectional view through a circular furnace incorporating a radial binding system according to a second preferred embodiment.
Figure 6:
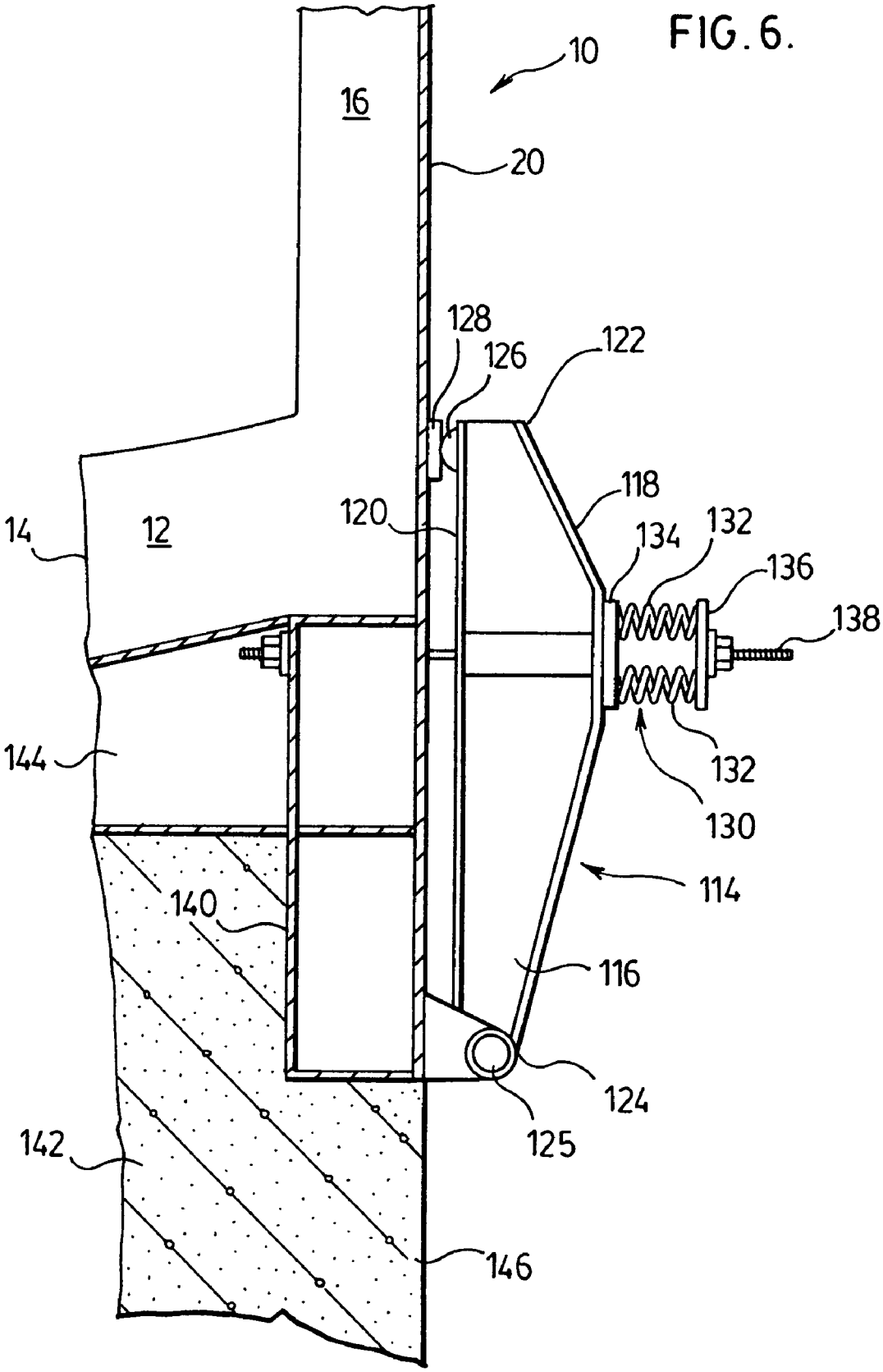
FIG. 6 is a close-up of one of the radial binding elements of the system shown in FIG. 5.

Another preferred radial binding system 100 is now described below for maintaining radial compression on the hearth 12 of circular furnace 10. This preferred embodiment is illustrated in FIGS. 5 and 6. Binding system 100 comprises a plurality of radial binding elements 114 arranged in spaced relation to one another about the circumference of furnace 10. Each radial binding element 114 comprises a pivoting member which is preferably in the form of a generally vertical beam 116 having an outer face 118, an inner face 120 in close relation to the furnace 10, an upper end 122 and a lower end 124. Each beam 116 is pivotable about a pivot point which, in the preferred embodiment shown in the drawings, is located proximate its lower end, at which the beam 116 is attached to a support member. The pivot point is located at an aperture 125 extending through the lower end 124 of beam 116, through which the beam is secured to the support member, such that the beam 116 pivots about an axis which is tangential to the furnace side wall 16.

The upper end 122 of beam 116 is in direct contact with the outer metal shell 20 of furnace 10, and applies a radially inwardly directive compressive force on the hearth 12. Preferably, as shown in FIG. 8, the inner face 120 of beam 116 is provided with a rounded protrusion 126 which is received in a cup-shaped member 128 on the furnace shell 20, through which the compressive force is applied.

Each radial binding element 114 further comprises a force generating member for applying a force to the beam 116. The force generating member in the preferred embodiment of the invention preferably comprises a hearth binding spring set 130 which is located between the upper and lower ends 122, 124 of the beam 116, preferably closer to the upper end 122 than to the lower end 124. The hearth binding spring set 130 preferably comprises one or more springs 132 compressed between two retaining plates 134 and 136, and may preferably be similar in structure to spring set assembly 42 described previously. The compressive force on furnace 10 is increased by increasing the compression of the springs 132. Alternatively, the force generating member may comprise a fluid-pressurized cylinder, preferably a hydraulic cylinder similar to cylinder 56 described previously.

The retaining plates 134 and 136 are apertured to receive a binding member 138, preferably comprising an elongate, threaded rod. One end of the binding member 138 is resiliently retained by the hearth binding spring set 130 as shown in FIG. 6. The opposite end of binding member 138 is secured against movement to a support member located below the hearth 12. Preferably, the support member comprises a ring beam 140 which forms part of a hearth supporting substructure 142 which may also include a plurality of radially extending beams 144 and a base 146 formed of concrete or other material. It will be appreciated that the construction of the hearth-supporting substructure 142 is only schematically shown in the drawings, and does not form part of the present invention.

It will be appreciated that the spring 132 exerts a radially inwardly directed force on beam 116, causing the beam to pivot about the pivot point and causing the upper end of beam 116 to be radially inwardly biased into compressive contact with the hearth 12.

Figure 7:
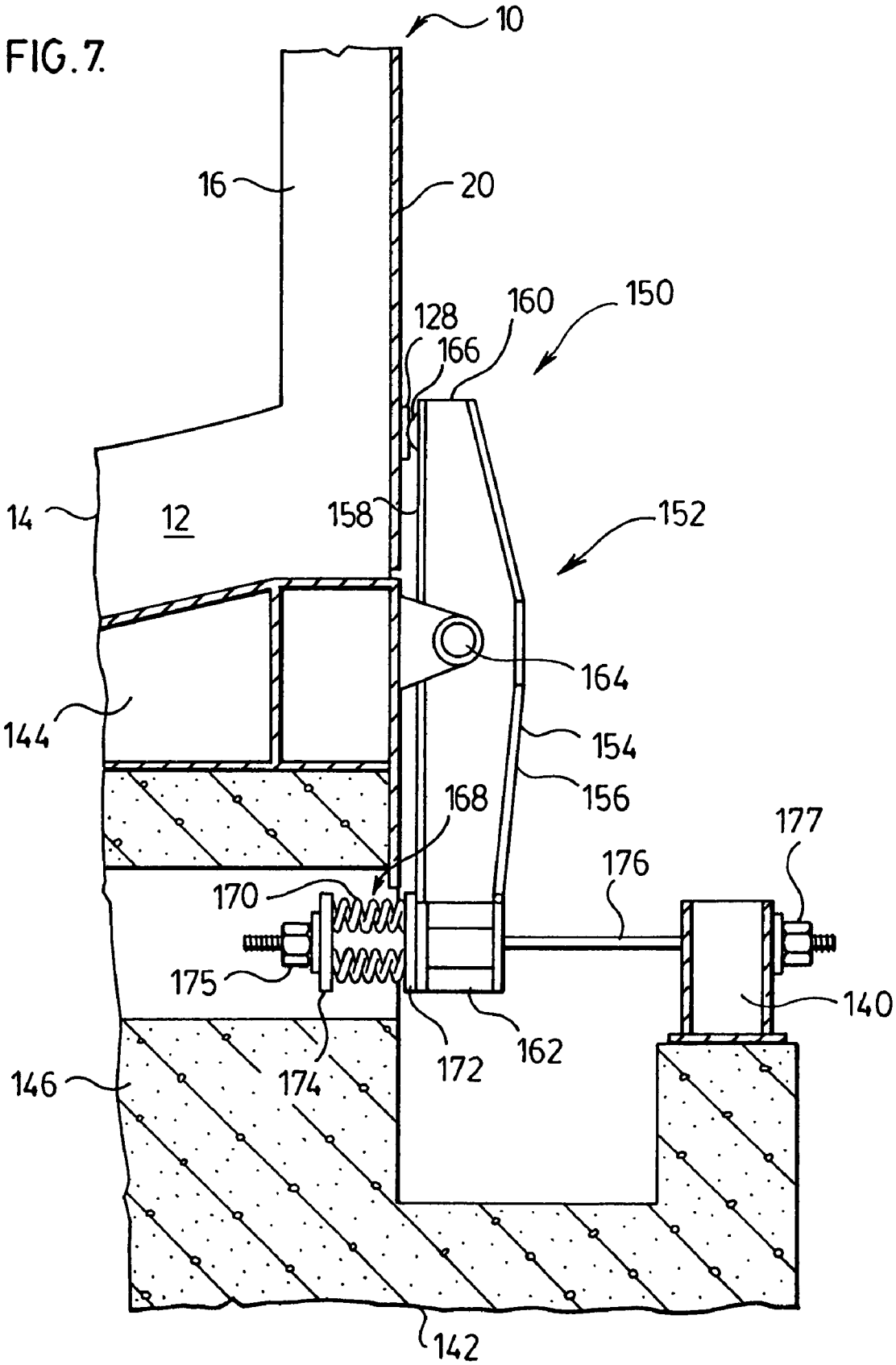
FIG. 7 is a close-up of a radial binding element in a binding system according to a third preferred embodiment of the invention.

FIG. 7 is a close-up view of one of the radial binding elements 152 of a third preferred radial binding system 150 according to the invention. Binding system 150 is similar to the system 100 described previously, and is now described below in detail.

Each radial binding element 152 of system 150 comprises a pivoting member which is preferably a generally vertical beam 154 having an outer face 156, an inner face 158 in close proximity to the furnace 10, an upper end 160 and a lower end 162. The beam 154 is pivotable about a pivot point which is located at or near the center of the beam 154, and at which the beam 154 is attached to a support member. The pivot point is located at an aperture 164 extending through the beam 154, through which the beam 154 is secured to the support member, such that the beam pivots about an axis which is tangential to the furnace side wall 16.

The upper end 160 of beam 154 is in direct contact with the outer metal shell 20 of furnace 10, and applies a radially inward compressive force on the hearth 12. As in the previously described embodiment, the inner face 158 of beam 154 is provided with a rounded protrusion 166 which is received in the cup-shaped member 128 on the furnace shell.

Each radial binding element 152 further comprises a force generating member for applying a force to the beam 154. The force generating member in the third preferred embodiment comprises a hearth binding spring set 168 which is located at the lower end 162 of the beam 154. Alternatively, the force generating member may comprise a fluid-pressurized cylinder, preferably a hydraulic cylinder similar to cylinder 56 described previously. The hearth binding spring set 168 preferably comprises one or more springs 170 compressed between two retaining plates 172, 174, but may instead comprise a hydraulic cylinder as mentioned in connection with the second preferred binding system 100. The retaining plates 172, 174 are apertured to receive a binding member 176, preferably comprising an elongate, threaded rod. One end of the binding member 176 is resiliently retained by nut 175 against retaining plate 174 of the hearth binding spring set 168 and the opposite end of binding member 176 is secured against movement by nut 177 to a support member located below the hearth 12. As in the second preferred embodiment, the support member comprises ring beam 140 which forms part of hearth supporting substructure 142. In the embodiment of FIG. 7, the ring beam 140 is located outwardly of the furnace wall 16. The compressive force on the furnace 10 is increased by increasing the compression of springs 170. In this preferred embodiment, the spring compression is adjusted by turning the nut 175 which is threaded on the end of binding member 176 passing through plate 174.

Although the invention has been described in connection with certain preferred embodiments, it is not to be limited thereto. Rather, the invention includes all embodiments which may fall within the scope of the following claims.

What is claimed is:

1. A circular furnace having a lower end and an upper end, comprising:

(a) a hearth comprised of a refractory material and located at the lower end of the furnace;

(b) a generally cylindrical sidewall extending from the hearth to the upper end of the furnace, the sidewall being comprised of a refractory material;

(c) a generally cylindrical, segmented metal shell surrounding the hearth and the sidewall, the shell being under tension to apply a radially inwardly directed compressive force on the furnace, wherein the shell is made up of two or more arcuate shell plates and wherein circumferentially spaced joints are formed between the arcuate shell plates, and wherein gaps are provided at the joints between the arcuate shell plates; and (d) a tensioning member for maintaining tension in the shell and applying a radial compressive force to the furnace;

wherein the tensioning member comprises an elongate band which extends around the shell proximate the lower end of the furnace, the band having first and second ends, and having sufficient length to extend around the sidewall, with a resilient connection being provided between the first and second ends of the band.

* * * * *